US010243310B1

(12) United States Patent
Monahan et al.

(10) Patent No.: US 10,243,310 B1
(45) Date of Patent: Mar. 26, 2019

(54) TECHNOLOGIES FOR SIMULTANEOUS ENGAGEMENT OF ELECTRICAL CONNECTORS

(71) Applicant: Cinch Connectivity Solutions, Inc., Lombard, IL (US)

(72) Inventors: Corey Monahan, Waseca, MN (US); Robert Baumler, Gulf Shores, AL (US)

(73) Assignee: Cinch Connectivity Solutions, Inc., Lombard, IL (US)

( * ) Notice: Subject to any disclaimer, the term of this patent is extended or adjusted under 35 U.S.C. 154(b) by 0 days.

(21) Appl. No.: 16/002,778

(22) Filed: Jun. 7, 2018

(51) Int. Cl.

| | |
|---|---|
| ***H01R 13/62*** | (2006.01) |
| ***H01R 25/00*** | (2006.01) |
| ***H01R 13/518*** | (2006.01) |
| ***H01R 13/621*** | (2006.01) |
| ***H01R 43/26*** | (2006.01) |
| ***H01R 13/631*** | (2006.01) |
| *H01R 24/52* | (2011.01) |

(52) U.S. Cl.
CPC ..... *H01R 25/003* (2013.01); *H01R 13/518* (2013.01); *H01R 13/6215* (2013.01); *H01R 13/631* (2013.01); *H01R 43/26* (2013.01); *H01R 24/52* (2013.01)

(58) Field of Classification Search
CPC ..... H01R 25/003; H01R 13/518; H01R 13/6215; H01R 13/631; H01R 43/26; H01R 24/52
USPC ..... 439/345, 368, 578–585, 660
See application file for complete search history.

(56) References Cited

U.S. PATENT DOCUMENTS

| | | | | |
|---|---|---|---|---|
| 4,700,304 | A | 10/1987 | Byrne et al. | |
| 5,287,061 | A | 2/1994 | Dechene et al. | |
| 6,394,523 | B1 | 5/2002 | Yoo et al. | |
| 6,794,578 | B2 | 9/2004 | Bracaleone | |
| 6,878,008 | B2 | 4/2005 | Brancaleone | |
| 6,902,422 | B1 | 6/2005 | Brancaleone | |
| 7,207,915 | B2 | 4/2007 | Oshidari et al. | |
| 7,211,734 | B2 | 5/2007 | Bracaleone | |
| 7,537,053 | B1 | 5/2009 | Hall et al. | |
| 7,785,140 | B2 * | 8/2010 | Henry | H01R 13/514 439/541.5 |
| 7,927,125 | B1 * | 4/2011 | Zieman | H01R 13/73 439/347 |
| 8,371,877 | B2 | 2/2013 | Kooiman | |

OTHER PUBLICATIONS

Amphenol Aerospace, <http://www.amphenol-aerospace.com/High-Speed-Connectors/quadrax-differential-twinax-for-mil-dt1-38999-connectors.html> (retrieved Jun. 7, 2018).

* cited by examiner

*Primary Examiner* — Khiem Nguyen
(74) *Attorney, Agent, or Firm* — Dentons US LLP; Brian R. McGinley; Roman Tsibulevskiy

(57) ABSTRACT

This disclosure discloses a technology that enables a first set of electrical connectors hosted via a first carrier board to simultaneously engage with a second set of electrical connectors hosted via a second carrier board. This simultaneous engagement occurs based on a movement of the first carrier board toward the second carrier board, or vice versa, such that the first set of electrical connectors progressively engages and aligns with the second set of electrical connectors to enable signal communication therethrough. The movement of the first carrier board toward the second carrier board can be facilitated via a fastener.

20 Claims, 6 Drawing Sheets

100A

100B

TECHNOLOGIES FOR SIMULTANEOUS ENGAGEMENT OF ELECTRICAL CONNECTORS

TECHNICAL FIELD

This disclosure relates to electrical connectors.

BACKGROUND

There is a desire for a technology to enable a first set of electrical connectors hosted via a first carrier board to simultaneously engage with a second set of electrical connectors hosted via a second carrier board. However, such technology does not exist. Therefore, this disclosure enables such technology.

SUMMARY

An embodiment includes a system comprising: a first carrier board hosting a plurality of male connectors, wherein at least one of the male connectors includes a first body that is conductive, a finger that is conductive and elastic, a first insulator portion, a first contact portion, a first dielectric portion, a second contact portion, and a pin, wherein the finger extends between the first body and the first insulator portion, wherein the first insulator portion extends between the finger and the first contact portion, wherein the first contact portion extends between the first insulator portion and the first dielectric portion, wherein the first dielectric portion extends between the first contact portion and the second contact portion, wherein the pin extends from the second contact portion; and a second carrier board hosting a plurality of female connectors, wherein at least one of the female connectors includes a second body that is conductive, a second insulator portion, a third contact portion, a second dielectric portion, a fourth contact portion, and a channel, wherein the second insulator portion extends between the second body and the third contact portion, wherein the third contact portion extends between the second insulator portion and the second dielectric portion, wherein the second dielectric portion extends between the third contact portion and the fourth contact portion, wherein the channel is defined via the fourth contact portion, wherein the pin is configured to extend in the channel when the first body contacts the second body and the finger extends between the second body and the third contact portion.

An embodiment includes a method comprising: accessing a first carrier board hosting a plurality of male connectors, wherein at least one of the male connectors includes a first body that is conductive, a finger that is conductive and elastic, a first insulator portion, a first contact portion, a first dielectric portion, a second contact portion, and a pin, wherein the finger extends between the first body and the first insulator portion, wherein the first insulator portion extends between the finger and the first contact portion, wherein the first contact portion extends between the first insulator portion and the first dielectric portion, wherein the first dielectric portion extends between the first contact portion and the second contact portion, wherein the pin extends from the second contact portion; accessing a second carrier board hosting a plurality of female connectors, wherein at least one of the female connectors includes a second body that is conductive, a second insulator portion, a third contact portion, a second dielectric portion, a fourth contact portion, and a channel, wherein the second insulator portion extends between the second body and the third contact portion, wherein the third contact portion extends between the second insulator portion and the second dielectric portion, wherein the second dielectric portion extends between the third contact portion and the fourth contact portion, wherein the channel is defined via the fourth contact portion; and moving the first carrier board toward the second carrier board such that the first body contacts the second body, the finger extends between the second body and the third contact portion, and the pin extends in the channel.

DETAILED DESCRIPTION OF PREFERRED EMBODIMENTS

Figure 1A:
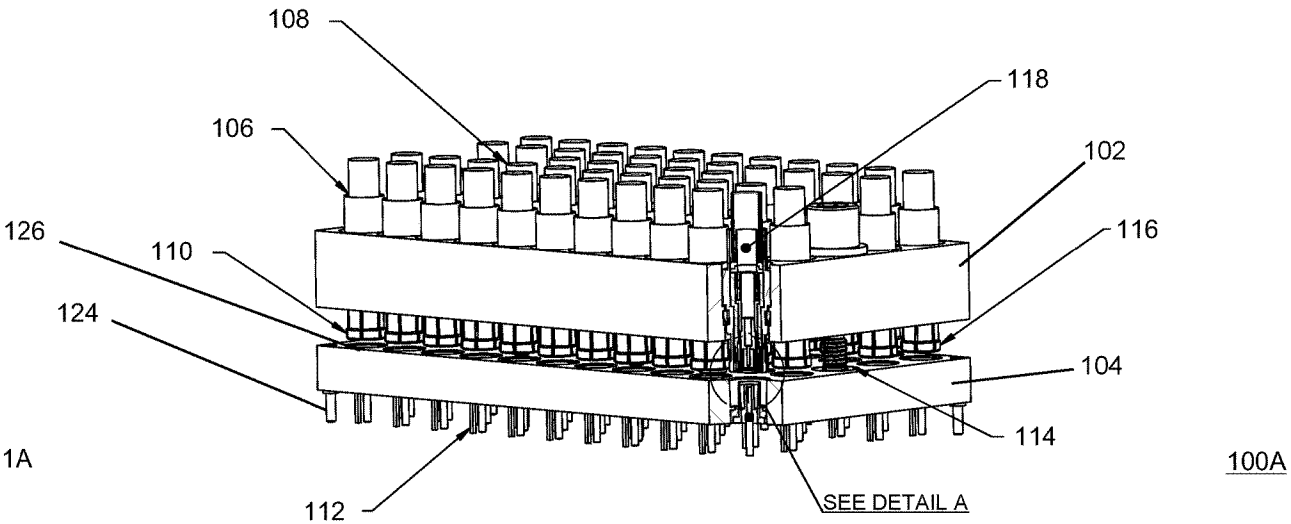
FIG. 1A shows a perspective view of an embodiment of a first set of electrical connectors hosted via a first carrier board simultaneously engaging with a second set of electrical connectors hosted via a second carrier board according to this disclosure.

Generally, this disclosure discloses a technology that enables a first set of electrical connectors hosted via a first carrier board to simultaneously engage with a second set of electrical connectors hosted via a second carrier board. This simultaneous engagement occurs based on a movement of the first carrier board toward the second carrier board, or vice versa, such that the first set of electrical connectors progressively engages and aligns with the second set of electrical connectors to enable signal communication therethrough. The movement of the first carrier board toward the second carrier board can be facilitated via a fastener, such as a bolt or a screw. However, note that this disclosure can be embodied in many different forms and should not be construed as necessarily being limited to any embodiments, as disclosed herein. Rather, all embodiments provided herein so that this disclosure is thorough and complete, and fully conveys various concepts of this disclosure to those skilled in a relevant art.

Various terminology used herein is provided for describing particular embodiments and is not intended to be necessarily limiting of this disclosure. As used herein, various singular forms "a," "an" and "the" are intended to include various plural forms as well, unless a context clearly indicates otherwise. Various terms "comprises," "includes" or "comprising," "including" when used in this specification, specify a presence of stated features, integers, steps, operations, elements, and/or components, but do not preclude the presence and/or addition of one or more other features, integers, steps, operations, elements, components, and/or groups thereof.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although terms, such as first, second, and others, can be used herein to describe various elements, components, regions, layers or sections, these elements, components, regions, layers or sections should not necessarily be limited by such terms. These terms are used to distinguish one element, component, region, layer or section from another element, component, region, layer or section. Thus, for example, a first element, component, region, layer, or section discussed below could be termed a second element, component, region, layer, or section without departing from various teachings of this disclosure.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Unless otherwise defined, all terms (including technical and scientific terms) used herein have a same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

FIG. 1A shows a perspective view of an embodiment of a first set of electrical connectors hosted via a first carrier board simultaneously engaging with a second set of electrical connectors hosted via a second carrier board according to this disclosure. In particular, a system 100A includes a first carrier board 102 and a second carrier board 104. The first carrier board 102 and the second carrier board 104 are spaced apart from each other, facing each other, and overlay each other. The first carrier board 102 and the second carrier board 104 can be identical to or different from each other in length, width, thickness, weight, symmetry/asymmetry, shape, size, density, material, or other properties. For example, the first carrier board 102 and the second carrier board 102 can be identical to or different from each other in thermal or electrical properties, such as conductivity, resistance, insulation, or others. The first carrier board 102 includes a plurality of first electrical insulators, such as rubber, plastic, or others. The second carrier board 104 includes a plurality of second electrical insulators, such as rubber, plastic, or others. The first carrier board 102 is shown as a cuboid, but this shape can vary, such as a cube, a sphere, a pyramid, a wedge, or others. Likewise, the second carrier board 104 is shown as a cuboid, but this shape can vary, such as a cube, a sphere, a pyramid, a wedge, or others.

The second carrier board 104 includes a plurality of legs 124 that extend from the second carrier board 104, whether orthogonally or non-orthogonally thereto, such that the legs 124 can support the second carrier board 104 over a surface, whether smooth, rough, flat, or bumpy, when the legs 124 stand on the surface. The legs 124 are unitary to the second carrier board 104, such as via being made as one piece with the second carrier board 104, although, in some embodiments, the legs 124 can be assembled with the second carrier board 104, such as via adhering, fastening, brazing, mating, or others. At least one of the legs 124 can be rectilinear or non-rectilinear, such as arcuate, sinusoidal, or others. Although the legs 124 are positioned in corners of the second carrier board 104, the legs 124 can be positioned in other areas of the second carrier board 104, such as centrally or others. In some embodiments, the second carrier board 104 includes a single leg 124, which can operates as a pedestal to the second carrier board 104.

The first carrier board 102 hosts a plurality of male connectors 106 arranged in an array manner, such as ganged or others. The second carrier board 104 hosts a plurality of female connectors 126 arranged in an array manner, such as ganged or others. Accordingly, the male connector 106 one-to-one correspond to the female connectors 126. For example, as shown in FIG. 1A, the male connectors 106 are arranged in a first pair of rows of the male connectors 106, a second pair of rows of the male connectors 106, and a third row of the male connectors 106, where the third row of the male connectors 106 is positioned between the first pair of rows and the second pair of rows, with the third row having less or more of the male connectors 106 than each of the first pair of rows and the second pair of rows, such as in an H-shape, N-shape manner or others. However, note that other arrangements of the male connectors 106 and the female connectors 126 are possible. Likewise, for example, the first carrier board 102 and the second carrier board 104 are each a connector body which retains multiple connectors, such as the male connectors 106 and the female connectors 126, respectively. Since each of the connectors 106, 126 can have multiple insulators, each of the boards 102, 104 can include multiple insulators.

Each of the male connectors 106 is field-replaceable and is coupled to a cable 118, such as a coaxial cable, which can be concentric, such as a twin-axial cable, a tri-axial cable, or others. As such, each of the male connectors 106 includes an end portion 116 that is configured accordingly, such as for engagement with a twin-axial cable end portion, a tri-axial cable end portion, or others.

Each of the male connectors 106 includes a finger 110 and an end portion 108. The fingers 110 are machined for consistent and tunable operation, while being configured for insertion into the female connectors 126. The end portions 108 are modularly configured (number of connections/ports), while being configured for receipt of the cables 118.

The system 100A further includes a fastener 114 that includes a head and a stem. The stem extends from the head and is threaded, whether clockwise or counterclockwise. As such, the stem can thread through the first carrier board 102 and the second carrier board 104. The head is positioned above the first carrier board 102, such as via the first carrier board 102 being positioned between the head and the second carrier board 104, and the stem extends from the head through the first carrier board 102 between the male connectors 106 and into the second carrier board 104 between the female connectors 126. In some embodiments, the fastener 114 extends from the second carrier board 104 to the first carrier board 102, such as via the second carrier board 104 being positioned between the head and the first carrier board 102. In some embodiments, the fastener 114 includes a nut that is threaded onto the stem distal to the head, whether the nut is positioned between the first carrier board 102 and the second carrier board 104 or positioned such that at least one of the first carrier board 102 or the second carrier board 104 is positioned between the head and the nut. Regardless, the head or the nut urges the first carrier board 102 to move toward the second carrier board 104, or vice versa depending on orientation of the head or the nut, when the stem is rotated with respect to the nut or the nut is rotated with respect to the stem, whether clockwise or counterclockwise. Resultantly, the fastener 114 enables locking and extraction of the first carrier board 102 and the second carrier board 104.

Each of the female connectors 126 includes a connection point or a lead 112 that is configured to engage with a printed circuit board (PCB) or a cable, which can be through soldering or others. For example, if at least one of the female connectors 126 is a cable connector, then that cable can be connected by soldering, crimping, using some form of a wrench nut, or others. Note that for a connector which is soldered, there could be any number of different board types which are available in the industry. For example, a Fire Retardant 4 (FR4), which is a glass fiber epoxy laminate, can used.

Figure 1B:
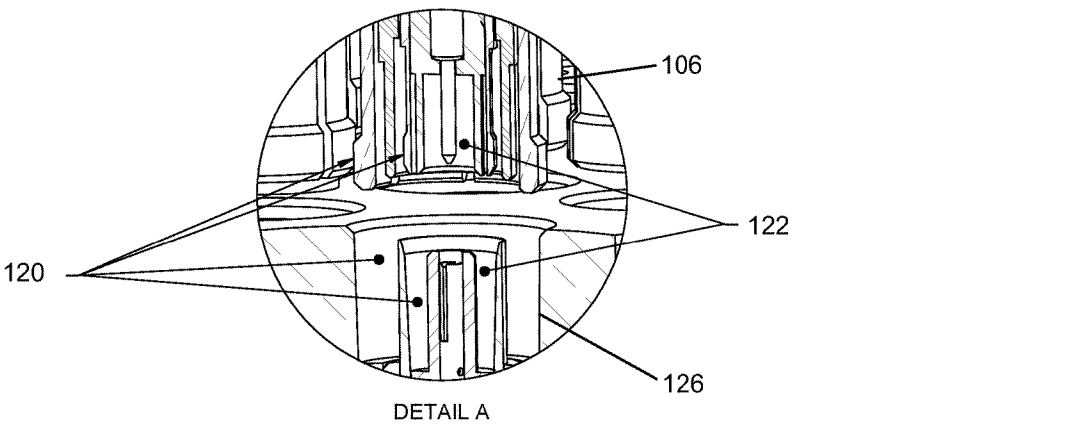
FIG. 1B shows a perspective view of an embodiment of a male connector of the first carrier board before mating with a female connector of the second carrier board according to this disclosure.

FIG. 1B shows a perspective view of an embodiment of a male connector of the first carrier board before mating with a female connector of the second carrier board according to this disclosure. In particular, a system 100B corresponds to Detail A of the system 100A. The system 100B includes the male connector 106 of the first carrier board 102 before mating with the female connector 126 of the second carrier board 104.

Figures 2A, 2B, 2C:
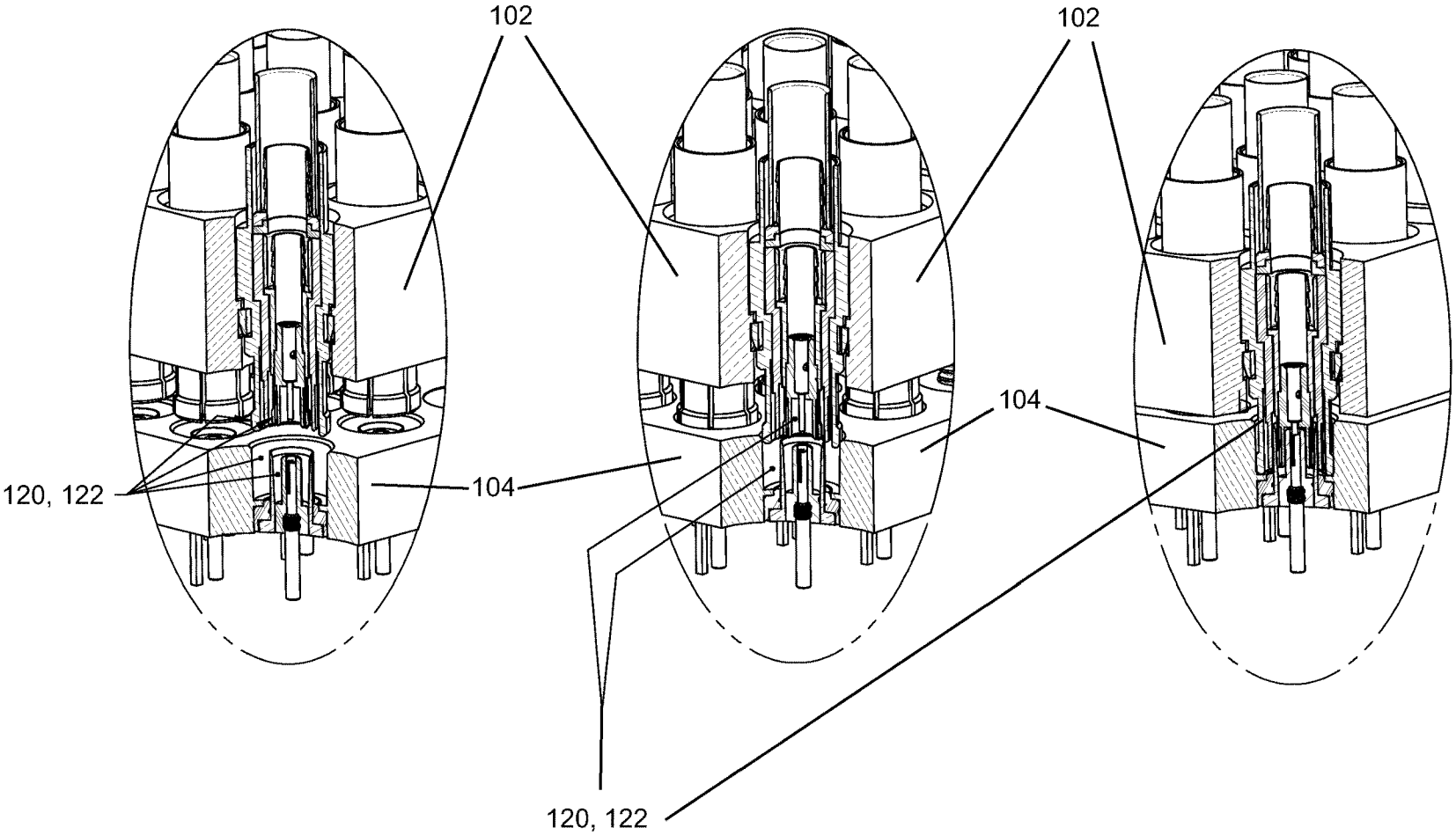
FIGS. 2A-2C show a perspective view of an embodiment of a progressive engagement of the male connector of the first carrier board with the female connector of the second carrier board according to this disclosure.

FIGS. 2A-2C show a perspective view of an embodiment of a progressive engagement of the male connector of the first carrier board with the female connector of the second carrier board according to this disclosure. In particular, the male connector 106 progressively mates with the female connector 126, or vice versa, such that a set features 120, 122 progressively engage and align, thereby preventing a potential damage that can result from misalignment, as further disclosed below.

FIGS. 3A-3D show a profile view of an embodiment of a progressive engagement of the male connector of the first carrier board with the female connector of the second carrier board according to this disclosure. In particular, the male connector 106 includes a first body 128 that is conductive, a finger 130 that is conductive and elastic, a first insulator portion 132, a first contact portion 134, a first dielectric portion 136, a second contact portion 138, and a pin 140. For example, the first body 128, which is outer, can include an electrically conductive metal, such as copper, aluminum, or others. The finger 130, which is outer, can include an electrically conductive metal, such as copper, aluminum, or others. The finger 130 can be a spring finger. The first insulator portion 132, which is outer, can include an electrically insulating material, such as plastic, rubber, or others. The first contact portion 134, which is intermediate, can include an electrically conductive metal, such as copper, aluminum, or others. The first dielectric portion 136, which is insulative, can include a dielectric material, such as polytetrafluoroethylene (PTFE), porcelain, plastic, glass or rubber (when insulative properties are needed), or others. The second contact portion 138, which is central, can include an electrically conductive metal, such as copper, aluminum, or others.

The finger 130 extends between the first body 128 and the first insulator portion 132. The first insulator portion 132 extends between the finger 130 and the first contact portion 134. The first contact portion 134 extends between the first insulator 132 and the first dielectric portion 136. The first dielectric portion 136 extends between the first contact portion 134 and the second contact portion 138. The pin 140 extends from the second contact portion 138.

The female connector 126 includes a second body 142 that is conductive, a second insulator portion 144, a third contact portion 146, a second dielectric portion 148, a fourth contact portion 150, and a channel 152. For example, the second body 142, which is outer, can include an electrically conductive metal, such as copper, aluminum, or others. The second insulator portion 144, which is outer, can include an electrically insulating material, such as plastic, rubber, or others. The third contact portion 146, which is intermediate, can include an electrically conductive metal, such as copper, aluminum, or others. The second dielectric portion 148, which is insulative, can include a dielectric material, such as PTFE, porcelain, plastic, glass or rubber (when insulative properties are needed), or others. The fourth contact portion 150, which is central, can include an electrically conductive metal, such as copper, aluminum, or others.

The second insulator portion 144 extends between the second body 142 and the third contact portion 146. The third contact portion 146 extends between the second insulator portion 144 and the second dielectric portion 148. The second dielectric portion 148 extends between the third contact portion 146 and the fourth contact portion 150. The channel 152 is defined via the fourth contact portion 150. The second body 142 defines an opening 154 that tapers toward the second insulator portion 144. The second body 142 extends about the third contact portion 146 concentrically.

Figure 3A:
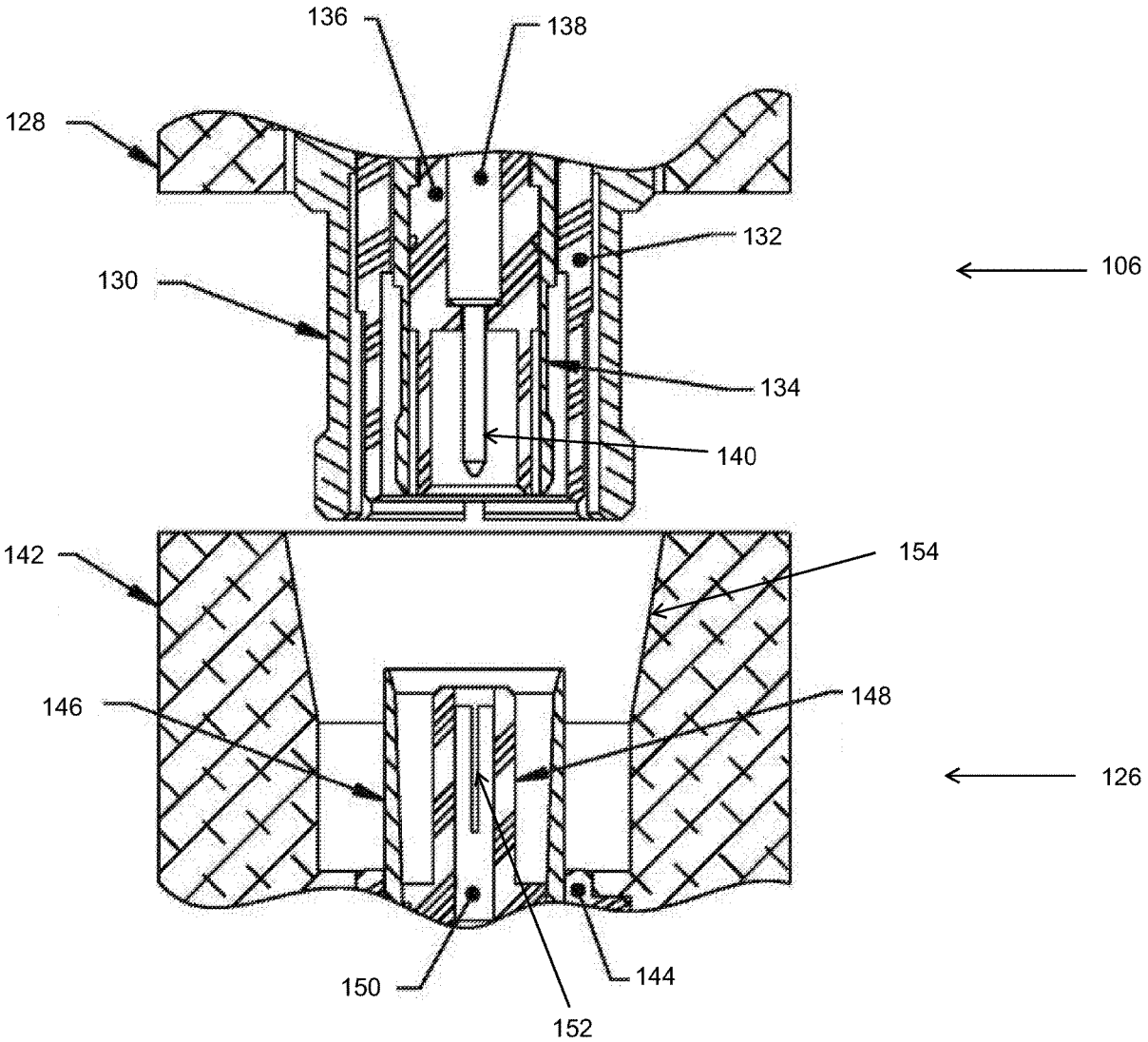
FIGS. 3A-3D show a profile view of an embodiment of a progressive engagement of the male connector of the first carrier board with the female connector of the second carrier board according to this disclosure.

As shown in FIG. 3A, prior to engagement/mating, the male connector 106 and the female connector 126 are positioned opposite each other such that the first body 128 faces the second body 142, the finger 130 is faces the opening 154, and the pin 140 faces the channel 152.

Figure 3B:
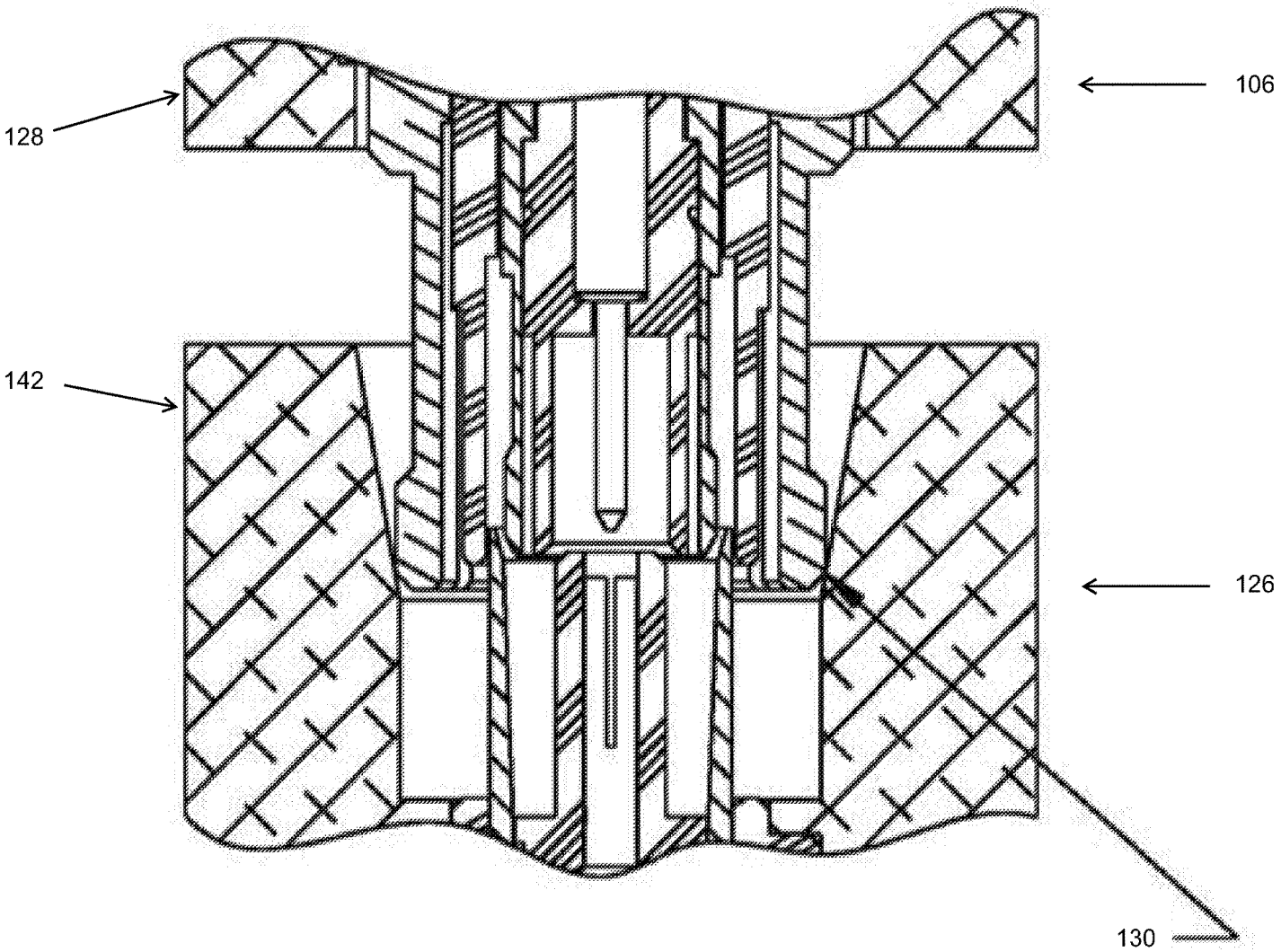

As shown in FIG. 3B, as the first carrier board 102 moves toward the second carrier board 104, or vice versa, such as via the fastener 114 actively fastening through the first carrier board 102 and the second carrier board 104, as explained above, the finger 130 enters the opening 154 and contacts the second body 142 and thereby begins engagement and alignment by flexing or bending inward and away from the second body 142. Note that inner engagement has not begun and outer engagement is occurring to ensure proper alignment. Further, note that, as also shown in FIGS. 1A-2B, the finger 130 is defined via a plurality of distinct portions that are elastic and spaced apart from each other. As such, the distinct portions can bend toward the third contact portion 146 independently as the first body 128 is moved toward the second body 142, such as when the distinct portions enter the opening 154 and contact the second body 142 independently.

Figure 3C:
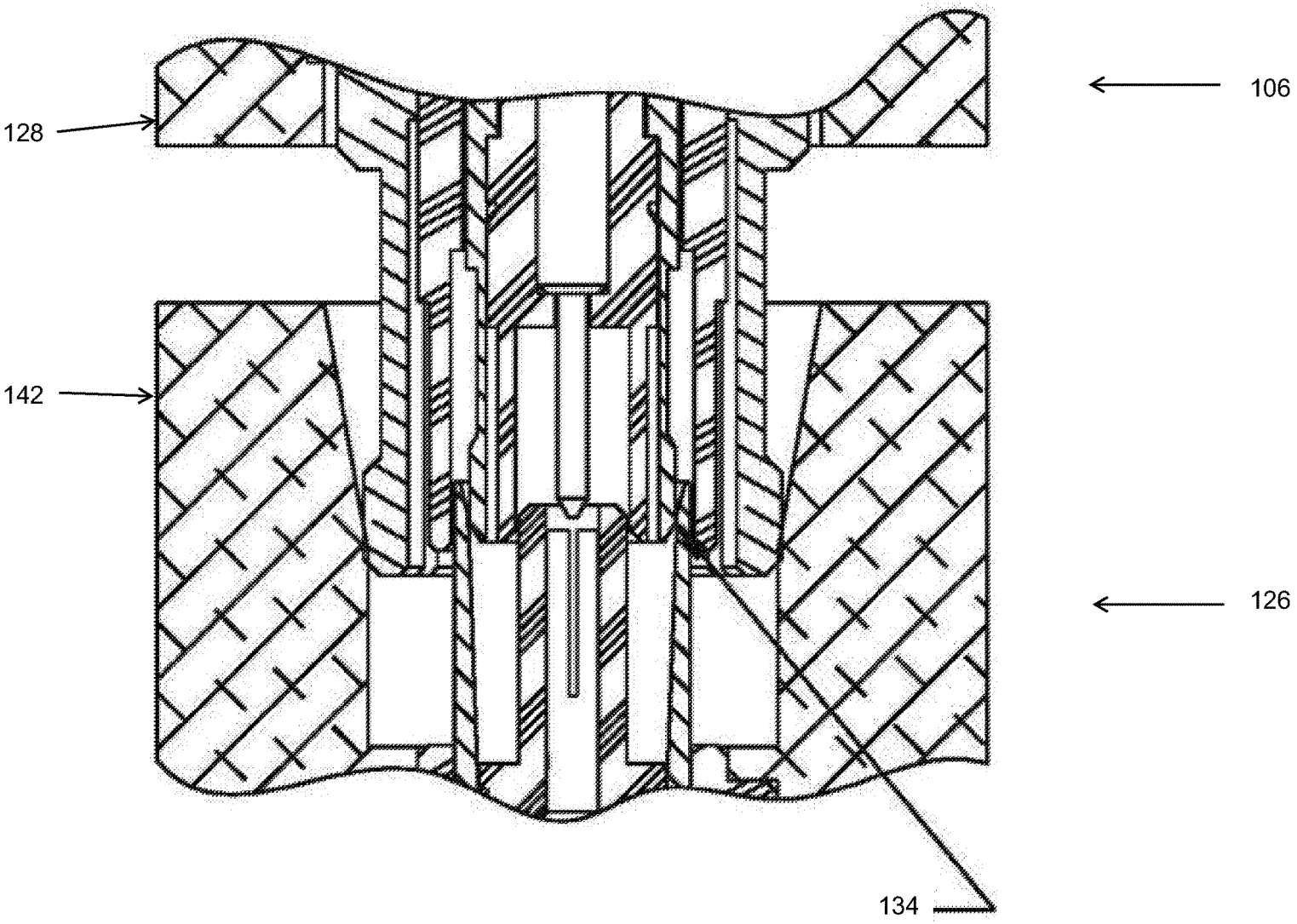

As shown in FIG. 3C, as the first carrier board 102 moves toward the second carrier board 104, or vice versa, such as via the fastener 114 actively fastening through the first carrier board 102 and the second carrier board 104, as explained above, the first contact portion 134 engages the third contact portion 146 via contact. Note that the outer engagement is in effect and the inner engagement has started. Also, note that the second contact portion 138 and the fourth contact portion 150 have not yet become engaged, but are properly aligned to engage.

Figure 3D:
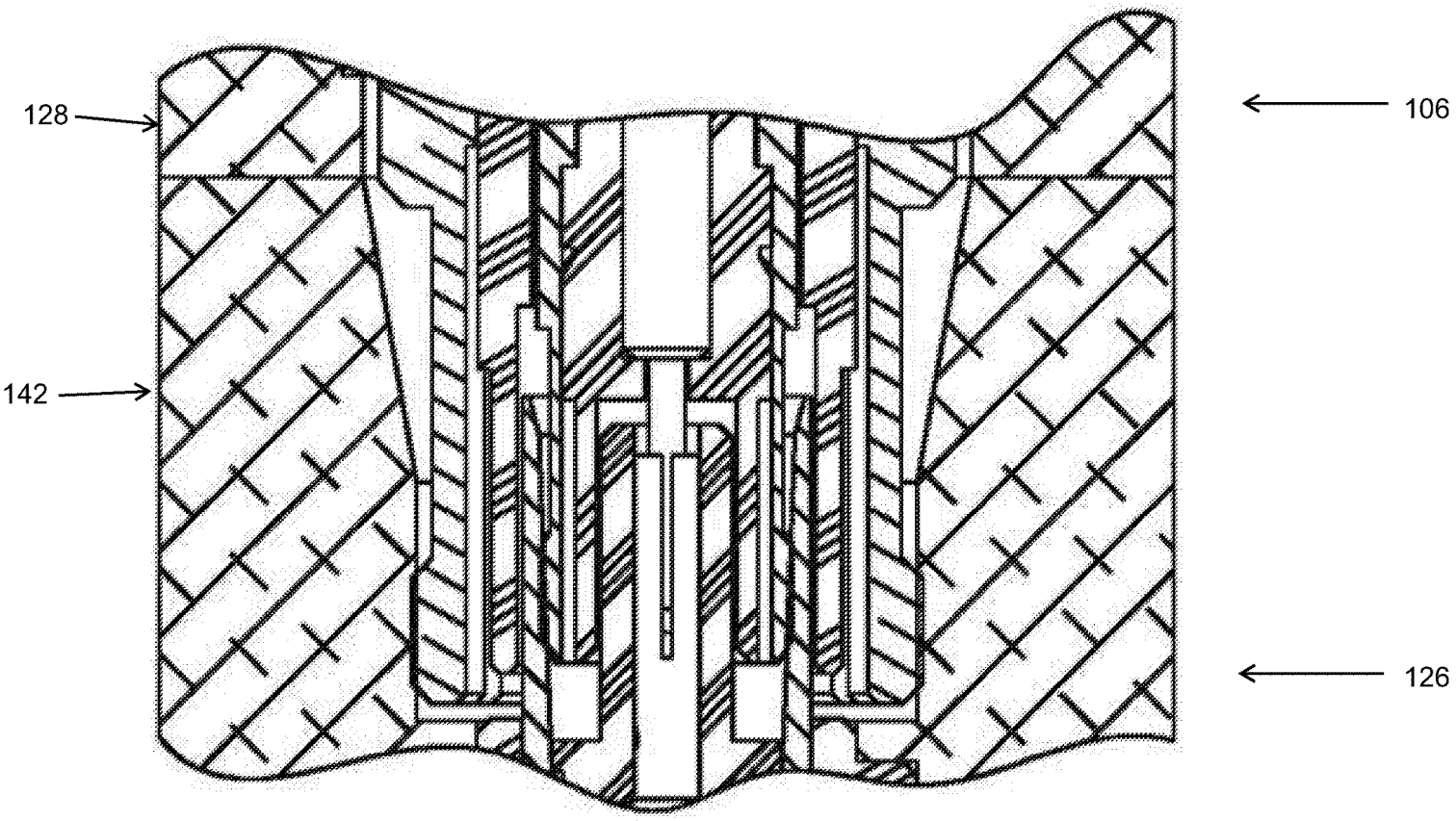

As shown in FIG. 3D, as the first carrier board 102 moves toward the second carrier board 104, or vice versa, such as via the fastener 114 actively fastening through the first carrier board 102 and the second carrier board 104, as explained above, such that the first body 128 contacts the second body 142. During such contact, the pin 140 extends in the channel 152 and the finger 130 extends between the second body 142 and the third contact portion 146, as the finger 130 contacts the second body 142 and the pin 140 contacts the fourth contact portion 150. Also, during such contact, the finger 130 extends between the second body 142 and the second dielectric portion 148. Moreover, during such contact, the finger 130 extends between the second body 142 and the fourth contact portion 150. Additionally, during such contact, the first contact portion 134 extends between the third contact portion 146 and the second dielectric portion 148, as the first contact portion 134 contacts the third contact portion 146. Furthermore, during such contact, the third contact portion 146 extends between the finger 130 and the fourth contact portion 150. Also, during such contact, since the opening 154 tapers toward the second insulator portion 144, the finger 130 bends toward the third contact portion 146 as the first body 128 contacts the second body 142. Moreover, during such contact, the second body 142 and the finger 130 define an empty space therebetween as the first body 128 contacts the second body 142.

Consequently, the male connector 106 and the female connector 126 mate based on an inward cascading technique, i.e., from some outer elements progressively working toward aligning some inner elements. This is important because some of the inner elements are smaller and may be more susceptible to damage during this mating process than some of the outer elements. Resultantly, based on such engagement, a user can enable communication via a plurality of signal channels, with each of the signal channels corresponding to a one-to-one correspondence between the male connectors 106 and the female connectors 126, so that the user can test the signal channels quickly and simultaneously, while efficiently packaging as many interconnect channels as possible in a smallest space possible in order to increase usage density.

Features described with respect to certain embodiments can be combined and sub-combined in or with various other embodiments. Also, different aspects or elements of embodiments, as disclosed herein, can be combined and sub-combined in a similar manner as well. Further, some embodiments, whether individually or collectively, can be components of a larger system, wherein other procedures can take precedence over or otherwise modify their application. Additionally, a number of steps can be required before, after, or concurrently with embodiments, as disclosed herein. Note that any or all methods or processes, at least as disclosed herein, can be at least partially performed via at least one entity in any manner.

Embodiments of this disclosure are described herein with reference to illustrations of idealized embodiments (and intermediate structures) of this disclosure. As such, variations from various illustrated shapes as a result, for example, of manufacturing techniques and/or tolerances, are to be expected. Thus, various embodiments of this disclosure should not be construed as necessarily limited to various particular shapes of regions illustrated herein, but are to include deviations in shapes that result, for example, from manufacturing.

This disclosure has been presented for purposes of illustration and description, but is not intended to be fully exhaustive or limited to disclosure in a form disclosed. Many modifications and variations in techniques and structures will be apparent to skilled artisans without departing from a scope and spirit of this disclosure as set forth in the claims that follow. Accordingly, such modifications and variations are contemplated as being a part of this disclosure.

What is claimed is:

1. A system comprising:

a first carrier board hosting a plurality of male connectors, wherein at least one of the male connectors includes a first body that is conductive, a finger that is conductive and elastic, a first insulator portion, a first contact portion, a first dielectric portion, a second contact portion, and a pin, wherein the finger extends between the first body and the first insulator portion, wherein the first insulator portion extends between the finger and the first contact portion, wherein the first contact portion extends between the first insulator portion and the first dielectric portion, wherein the first dielectric portion extends between the first contact portion and the second contact portion, wherein the pin extends from the second contact portion; and a second carrier board hosting a plurality of female connectors, wherein at least one of the female connectors includes a second body that is conductive, a second insulator portion, a third contact portion, a second dielectric portion, a fourth contact portion, and a channel, wherein the second insulator portion extends between the second body and the third contact portion, wherein the third contact portion extends between the second insulator portion and the second dielectric portion, wherein the second dielectric portion extends between the third contact portion and the fourth contact portion, wherein the channel is defined via the fourth contact portion, wherein the pin is configured to extend in the channel when the first body contacts the second body and the finger extends between the second body and the third contact portion.

2. The system of claim 1, wherein the male connectors are arranged in an array manner on the first carrier board.

3. The system of claim 1, wherein the female connectors are arranged in an array manner on the second carrier board.

4. The system of claim 1, wherein the pin is configured to extend in the channel when the finger extends between the second body and the second dielectric portion.

5. The system of claim 1, wherein the pin is configured to extend in the channel when the finger extends between the second body and the fourth contact portion.

6. The system of claim 1, wherein the pin is configured to extend in the channel when the first contact portion extends between the third contact portion and the second dielectric portion.

7. The system of claim 1, wherein the pin is configured to extend in the channel when the third contact portion extends between the finger and the fourth contact portion.

8. The system of claim 1, wherein the second body defines an opening that tapers toward the second insulator portion such that the finger is able to bend toward the third contact portion when the first body contacts the second body.

9. The system of claim 1, wherein the second body extends about the third contact portion concentrically.

10. The system of claim 1, wherein the finger is defined via a plurality of distinct portions that are elastic and spaced apart from each other such that the distinct portions bend toward the third contact portion independently when the first body is moved toward the second body.

11. The system of claim 1, further comprising:

a fastener extending through the first carrier board between the male connectors and the second carrier board between the female connectors.

12. The system of claim 1, wherein the second body and the finger define an empty space therebetween when the first body contacts the second body.

13. A method comprising:

accessing a first carrier board hosting a plurality of male connectors, wherein at least one of the male connectors includes a first body that is conductive, a finger that is conductive and elastic, a first insulator portion, a first contact portion, a first dielectric portion, a second contact portion, and a pin, wherein the finger extends between the first body and the first insulator portion, wherein the first insulator portion extends between the finger and the first contact portion, wherein the first contact portion extends between the first insulator portion and the first dielectric portion, wherein the first dielectric portion extends between the first contact portion and the second contact portion, wherein the pin extends from the second contact portion;

accessing a second carrier board hosting a plurality of female connectors, wherein at least one of the female connectors includes a second body that is conductive, a second insulator portion, a third contact portion, a second dielectric portion, a fourth contact portion, and a channel, wherein the second insulator portion extends between the second body and the third contact portion, wherein the third contact portion extends between the second insulator portion and the second dielectric portion, wherein the second dielectric portion extends between the third contact portion and the fourth contact portion, wherein the channel is defined via the fourth contact portion; and moving the first carrier board toward the second carrier board such that the first body contacts the second body, the finger extends between the second body and the third contact portion, and the pin extends in the channel.

14. The method of claim 13, wherein moving the first carrier board toward the second carrier board enables the finger to extend between the second body and the second dielectric portion.

15. The method of claim 13, wherein moving the first carrier board toward the second carrier board enables the finger to extend between the second body and the fourth contact portion.

16. The method of claim 13, wherein moving the first carrier board toward the second carrier board enables the first contact portion to extend between the third contact portion and the second dielectric portion.

17. The method of claim 13, wherein moving the first carrier board toward the second carrier board enables the third contact portion to extend between the finger and the fourth contact portion.

18. The method of claim 13, wherein the second body defines an opening that tapers toward the second insulator portion such that the finger is able to bend toward the third contact portion as the first body contacts the second body.

19. The method of claim 13, wherein the finger is defined via a plurality of distinct portions that are elastic and spaced apart from each other such that the distinct portions bend toward the third contact portion independently as the first carrier board is moving toward the second carrier board.

20. The method of claim 13, wherein the second body and the finger define an empty space therebetween when the first body contacts the second body.

* * * * *